United States Patent [19]

Mohring et al.

[11] Patent Number: 5,060,855

[45] Date of Patent: Oct. 29, 1991

[54] FUEL-FIRED HEATER FOR MOTOR VEHICLES

[75] Inventors: Fritz Mohring, Ostfildern; Martin Stoll, Reutlingen, both of Fed. Rep. of Germany

[73] Assignee: Eberspächer, Esslingen, Fed. Rep. of Germany

[21] Appl. No.: 429,796

[22] Filed: Oct. 31, 1989

[30] Foreign Application Priority Data

Oct. 31, 1988 [DE] Fed. Rep. of Germany ..... 3837075

[51] Int. Cl.[5] ..... B60H 1/02

[52] U.S. Cl. ..... 237/12.3 C; 431/75

[58] Field of Search ..... 237/12.3 C, 2 A; 431/36, 23, 37, 62, 63, 66, 75; 126/350 A, 110 B

[56] References Cited

U.S. PATENT DOCUMENTS 4,744,747 5/1988 Kawamura et al. ..... 237/12.3 C X

*Primary Examiner*—Henry A. Bennet

*Attorney, Agent, or Firm*—McGlew & Tuttle

[57] ABSTRACT

An arrangement for space heaters for motor vehicles, which are fired with liquid fuel including, (depending on the type of burner used), a glow plug for either igniting a fuel/air mixture and/or vaporizing fuel. Only one type of glow plug, i.e., a glow plug designed for a 12-V electrical system, is normally employed. If the motor vehicle has a 24-V battery, a compensating resistor, which has the same electrical resistance as the glow plug, is connected in series with the glow plug. The amount of electrical energy converted into heat in the compensating resistor is practically equal to that transformed in the glow plug. The compensating resistor is integrated within the burner housing, in which case it is located in the flow path of the combustion air and is properly cooled by the air flowing past it, to provide a safe trouble free and space-saving arrangement.

8 Claims, 1 Drawing Sheet

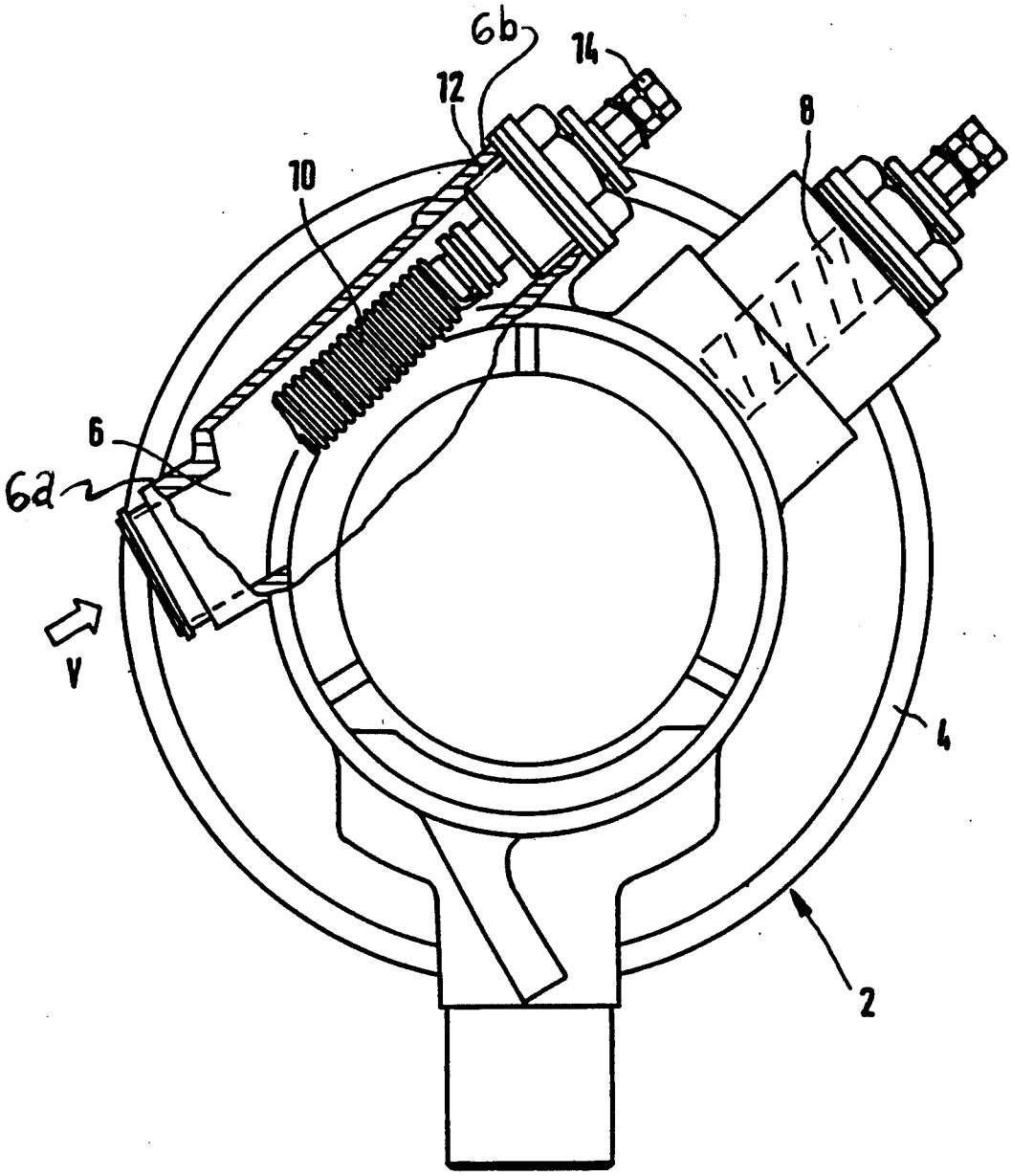
6b
14
12
8
10
6
6a
V
4
2

FUEL-FIRED HEATER FOR MOTOR VEHICLES

FIELD OF THE INVENTION

The present invention pertains to a fuel-fired heater for motor vehicles, comprising a combustion chamber housing, into which combustion air, which mixes with fuel, is introduced, a glow plug for igniting the mixture and/or vaporizing liquid fuel, and a compensating resistor, which is connected in series with said glow plug are also provided.

BACKGROUND OF THE INVENTION

Such heaters, which are also called space heaters, auxiliary heaters, external heaters, etc., have a burner in an approximately cylindrical combustion chamber housing. The burner is arranged axially relative to the combustion chamber housing. Combustion air is introduced either axially or tangentially into the combustion chamber housing. There are various types of burners in terms of the type of fuel processing (burners with mechanical atomizers, vaporizing burners, or burners with rotary atomizers).

In the vaporizing burners, the liquid fuel is vaporized with a glow plug and ignited by said glow plug or ignited by a high-voltage electrode. In other burner types, the mixture is ignited by high-voltage electrodes or a glow plug.

Passenger cars and utility vehicles are known to have 12-V power systems or 24-V power systems. For practical considerations, one type of glow plugs, i.e., glow plugs for an operating voltage of 12 V, are exclusively used in the heaters being discussed here. If the heater is subsequently installed in a vehicle that has a 24-V battery, a compensating resistor, whose electrical resistance corresponds to that of the glow plug, is connected in series with the glow plug, so that the glow plug will have the correct rated voltage of 12 V.

The amount of energy converted into heat in the compensating resistor is equal to that transformed in the glow plug. The compensating resistor has hitherto been arranged in an area under the hood, where sufficient cooling by ambient air seemed to be guaranteed. Such a separate arrangement of the compensating resistor makes the installation of the heater both relatively expensive and exposes the compensating resistor to damage. The compensating resistor designed as a separate component is inherently expensive. In addition, the compensating resistor must be arranged such as to positively prevent it from excessive heating under any circumstance.

SUMMARY AND OBJECT OF THE INVENTION

It is an object of the present invention to provide a heater of the type specified in the introduction, which is compact in design and in which good and sufficient cooling of the compensating resistor is always guaranteed.

According to the present invention the compensating resistor is at least partially positioned in the combustion chamber housing. The compensating resistor is advantageously screwed into a threaded socket provided in the combustion chamber housing.

The combustion chamber housing, which is usually approximately cylindrical, carries on its outside a number of individual parts belonging to the heater, e.g., an electric motor for a combustion air blower, a flame guard, and the like. According to the invention, the compensating resistor for the glow plug is also arranged on or in the combustion chamber housing. A separate component of the heater is thus eliminated, so that the heater itself can be manufactured at a relatively low cost and its installation is also substantially simplified.

The compensating resistor is usually equipped — in the present invention as well — with resistor windings, which permit good air cooling. A particularly favorable arrangement of such a compensating resistor is provided positioning the compensating resistor in the flow path of the combustion air. When the glow plug for igniting the burner is heated, the compensating resistor is also heated at the same time. When the combustion air blower is subsequently turned on, the combustion air sweeps the compensating resistor and cools it. The combustion air is slightly heated at the same time before it is mixed with the fuel.

According to the invention, using a heater with an approximately cylindrical combustion chamber housing, the compensating resistor is provided in a plane perpendicular to the longitudinal center line of the combustion chamber housing, approximately tangentially to the housing. A combustion air intake duct or canal is provided in the combustion air housing opposite the compensating resistor. This design solution is extremely space-saving. The combustion air blown tangentially into the inside of the combustion chamber effectively cools the compensating resistor on flowing past it.

When installing the heater according to the present invention, the installer does not need to be concerned about the arrangement of the compensating resistor at all. The end of the screwed-in compensating resistor that projects outward from the combustion chamber housing carries the electrical connections, so that wiring can be performed with ease.

A further object of the invention is to provide a safe and easy to maintain fuel fired heater including a housing defining a combustion chamber the housing having an air intake duct providing an air passage into the chamber, the fuel mixing with incoming air in the combustion chamber, the glow plug positioned for vaporizing o igniting the fuel in the combustion chamber and the compensating resistor. The arrangement is particularly unique in that the compensating resistor is positioned at least partially in the housing connected to the housing, preferably connected in the air intake duct. The air intake duct is preferably provided having an air intake end and also a compensating resistor end into which the compensating resistor may be passed. A terminal support element engages threads provided in the compensating resistor end of the air intake duct to provide an electrical contact to the compensating resistor and support the compensating resistor.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

BRIEF DESCRIPTION OF THE DRAWINGS

In the drawings:

The only figure is a drawing of a partially cutaway cross sectional view of an auxiliary heater fired with liquid fuel for a motor vehicle.

DESCRIPTION OF THE PREFERRED EMBODIMENT

Referring to the drawings in particular, the invention embodied therein includes a fuel fired heater generally designated 2 with a housing 4 defining a combustion chamber, including an air intake duct 6 providing an air passage into the combustion chamber, the fuel mixing with incoming air in the combustion chamber. A glow plug 8 is provided positioned for one of igniting and vaporizing the fuel in the combustion chamber. A compensating resistor 10 is connected in series with the glow plug 8. The compensating resistor 10 is positioned at least partially in the housing of the combustion chamber. The housing preferably is provided such that the air intake duct 6 includes an air intake end 6A and a compensating resistor end 6B. The arrangement allows the compensating resistor to be engaged by a contact arrangement 14 and positioned treadily engaged with threads 1 at compensating resistor end 6B to securely hold the compensating resistor 10 with respect to the housing 4.

The figure shows the front side of the heater 2. A burner, with a rotary vaporizer, is arranged in the combustion chamber housing, which is of approximately cylindrical shape. In the embodiment shown, combustion air V is introduced into the inside of the combustion chamber via a flexible tube (not shown) and an intake duct 6 provided in the housing. There the combustion air mixes with atomized fuel, e.g., diesel fuel. Ignition is performed with a glow plug 8, which is arranged radially with respect to the housing. As shown in the figure, the intake duct 6 for intake of combustion air is arranged on the front side of the combustion chamber housing 4. This intake duct 6 delivers the combustion air V via an opening located below the compensating resistor or drop resistor 10, into the combustion chamber 18. As shown in the figure, the combustion chamber 18 is provided as an insert positioned in a space within the combustion chamber housing 4 and the combustion chamber 18 is held by webs 20. In this way a lateral pre-chamber is formed into which the glow plug 8 extends. The combustion chamber 18 which forms an insert defines a combustion zone or space 16.

In addition, a threaded socket 12, is arranged on the combustion chamber housing 4, slightly obliquely opposite said intake duct 6. The compensating resistor 10, equipped with resistor windings is screwed into the socket 12. The compensating resistor 10 may be designed with open windings or with windings arranged in a sleeve. Via terminals 14, the compensating resistor 10 is connected to the glow plug 8 and other parts of the electrical system via electrical connection 20.

When the combustion air blower is turned on when starting the burner, the combustion air V flows into the intake duct 6 and then flows partially past the resistor windings of the compensating resistor 10. The compensating resistor 10, which is intensely heated when the glow plug 8 is turned on, is cooled by the combustion air flow V flowing past the compensating resistor 10.

Modifications of the above-described embodiment of the present invention are possible. The compensating resistor does not need to be arranged tangentially in the combustion chamber housing. It may also be arranged axially or completely radially. This depends on how the combustion air V is introduced into the combustion chamber. Radial arrangement of the compensating resistor may be recommended if the combustion air is to be introduced axially.

While a specific embodiment of the invention has been shown and described in detail to illustrate the application of the principles of the invention, it will be understood that the invention may be embodied otherwise without departing from such principles.

What is claimed is:

1. A fuel fired heater for mobile units, comprising:

a housing defining a combustion chamber including an air intake duct providing an air passage into said chamber, the fuel mixing with incoming air in the combustion chamber;

a glow plug positioned for one of igniting and vaporizing the fuel in the combustion chamber; and a compensating resistor positioned at least partially in said housing of the combustion chamber, said compensating resistor including an electrical terminal extending outside said housing for electrically connecting said compensating resistor and said glow plug in series.

2. A fuel-fired heater according to claim 1, wherein said compensating resistor is screwed into a threaded socket provided in the combustion chamber housing.

3. A fuel-fired heater according to claim 1, wherein said compensating resistor includes resistor windings.

4. A fuel-fired heater according to claim wherein said compensating resistor is arranged in the flow path in the combustion air.

5. A heater according the claim 2, wherein said housing defines a substantially cylindrical combustion chamber, said compensating resistor being arranged in a plane perpendicular to a longitudinal center axis of the combustion chamber, substantially tangentially to said combustion chamber, said combustion air intake duct is provided formed with said combustion chamber housing opposite said compensating resistor.

6. A fuel-fired heater according to claim 1, wherein said air intake duct includes a first air intake end and a second compensating resistor end, said compensating resistor end, including a threaded socket, said compensating resistor being connected to a terminal support member, said terminal support member being engaged with said threaded socket to fix said compensating resistor within said air duct and support said compensating resistor.

7. A fuel fired heater for mobile units, comprising:

a housing defining a combustion chamber including an air intake duct providing an air passage into said chamber, the fuel mixing with incoming air in the combustion chamber;

a glow plug positioned for one of igniting and vaporizing the fuel in the combustion chamber; and, a compensating resistor positioned at least partially in said housing of the combustion chamber, said compensating resistor including an electrical terminal extending outside said housing for electrically connecting said compensating resistor and said glow plug in series, said air intake duct includes a first air intake end and a second compensating resistor end, said compensating resistor end, including a threaded socket, said compensating resistor being connected to a terminal support member, said terminal support member being engaged with said threaded socket to fix said compensating resistor within said air duct and support said compensating resistor.

8. A fuel-fired heater for mobile units comprising:

a housing defining a combustion chamber including an air intake duct provided with an air passage communication with said chamber; a glow socket formed in said housing providing an opening for receiving a glow plug; a glow plug positioned in said glow plug socket having an end extending into said chamber and having a terminal end extending out of said chamber; a compensating resistor socket formed in said air passage portion of said housing, said compensating resistor socket forming an opening for receiving a compensating resistor; a compensating resistor including heat dissipating resistor windings, said heat dissipating resistor windings being positioned in said air passage, said compensating resistor including a terminal end extending out of said housing, said terminal end of said compensating resistor being positioned adjacent said terminal end, said compensating resistor and said glow plug in being electrically connected series.

* * * * *